US009587365B2

(12) United States Patent
Seidel

(10) Patent No.: US 9,587,365 B2
(45) Date of Patent: Mar. 7, 2017

(54) COMPOSITE STRUCTURE FOR A PILE FOUNDATION FOR ANCHORING A TOWER STRUCTURE, FOUNDATION AND JACKET FOR A WIND TURBINE, AND WIND TURBINE

(71) Applicant: REPOWER SYSTEMS SE, Hamburg (DE)

(72) Inventor: Marc Seidel, Osnabrück (DE)

(73) Assignee: Senvion SE, Hamburg (DE)

( * ) Notice: Subject to any disclaimer, the term of this patent is extended or adjusted under 35 U.S.C. 154(b) by 0 days.

(21) Appl. No.: 14/437,482

(22) PCT Filed: Sep. 4, 2013

(86) PCT No.: PCT/EP2013/002660
§ 371 (c)(1),
(2) Date: Apr. 21, 2015

(87) PCT Pub. No.: WO2014/063765
PCT Pub. Date: May 1, 2014

(65) Prior Publication Data

US 2015/0308067 A1 Oct. 29, 2015

(30) Foreign Application Priority Data

Oct. 24, 2012 (DE) ..... 10 2012 020 871

(51) Int. Cl.
*E02D 27/42* (2006.01)
*E02D 5/48* (2006.01)
(Continued)

(52) U.S. Cl.
CPC ..... *E02D 27/425* (2013.01); *E02D 5/48* (2013.01); *E02D 5/526* (2013.01); *E02D 27/12* (2013.01); *E02D 27/42* (2013.01)

(58) Field of Classification Search
CPC E02D 5/48; E02D 27/12; E02D 27/42; E02D 27/425
See application file for complete search history.

(56) References Cited

U.S. PATENT DOCUMENTS 3,362,171 A * 1/1968 Arpaia ..... E02D 5/44 405/244
3,832,857 A * 9/1974 Bassett ..... E02B 17/0008 405/225

(Continued)

FOREIGN PATENT DOCUMENTS

JP S6397711 A 4/1988
WO 2011/010937 A1 1/2011

*Primary Examiner* — Benjamin Fiorello
*Assistant Examiner* — Aaron Lembo
(74) *Attorney, Agent, or Firm* — Rankin, Hill & Clark LLP

(57) ABSTRACT

A composite structure for a pile foundation for anchoring a tower structure (e.g., an offshore wind turbine) in ground, which includes a hollow pile introduced into the ground at an erection site of the tower structure and a corner post which is connected to the tower structure and which, on a connection side, is arranged within the pile. The pile and the corner post are fixedly bonded to one another in a bonding region by a cured bonding material. At least one bonding means for transmitting shear forces is fixedly arranged on the pile and/or on the corner post in the bonding region. The bonding means has at least one aperture which is filled with the bonding material or, together with the corner post or pile, forms the aperture that is filled with the bonding material. The aperture encloses the bonding material by an angular range of 90° or more.

12 Claims, 4 Drawing Sheets

(51) Int. Cl.
*E02D 5/52* (2006.01)
*E02D 27/12* (2006.01)

(56) References Cited

U.S. PATENT DOCUMENTS 4,102,143 A * 7/1978 Phares ..... E02B 17/027 24/526
6,123,485 A * 9/2000 Mirmiran ..... E02D 31/02 405/232
2010/0239375 A1* 9/2010 Feygin ..... E02D 17/00 405/284
2011/0135401 A1* 6/2011 Hall ..... E02D 5/523 405/233
2013/0302096 A1* 11/2013 Rodr Guez Tsouroukdissian ... F03D 11/045 405/225
2015/0082720 A1* 3/2015 Rodriguez Tsouroukdissian . E02B 17/0008 52/298
2015/0218796 A1* 8/2015 Seidel ..... E02D 27/42 52/298
2015/0308067 A1* 10/2015 Seidel ..... E02D 27/42 405/250
2015/0376859 A1* 12/2015 Phuly ..... E02D 27/42 52/223.1

* cited by examiner discontinuous bonding means:

continuous bonding means

COMPOSITE STRUCTURE FOR A PILE FOUNDATION FOR ANCHORING A TOWER STRUCTURE, FOUNDATION AND JACKET FOR A WIND TURBINE, AND WIND TURBINE

The present invention relates to a composite structure for a pile foundation for anchoring a tower structure in accordance with the preamble of claim 1. The invention particularly relates to a composite structure for a wind turbine, especially for an offshore wind turbine. Further aspects of the invention relate to a foundation for a tower and a jacket for example for a wind turbine, and a wind turbine. The invention particularly concerns applications in the offshore field.

It is customary to anchor a tower structure in the ground via a foundation and to dissipate the loads acting on the tower structure into the ground. In the case of wind turbines, and here in particular in the case of offshore wind turbines, pile foundations are known in order to anchor the wind turbine towers in the seabed and in order to dissipate the static and dynamic loads into the seabed. The connections of such pile foundations to the rising structure are preferably produced in a composite structure. This means that a combination of steel and mortar (for example high-strength concrete) is used, via which the forces, for example longitudinal shear forces, acting on the tower structure are transmitted into the ground.

A known pile foundation comprises, for example, a hollow pile which is introduced into the ground, for example by pile-driving. A jacket leg or a tripod leg or else the (single) leg of a monopile is arranged in the hollow pile, wherein this leg is coupled to the tower structure. Without any loss of generality, mention is always made below of a corner post in order to provide all the aforementioned legs with a uniform term even if, according to conventional understanding, a corner post is part of a lattice structure. In the present application, the designation corner post is to be understood in a widened sense.

Besides monopiles, lattice structures (jackets) in particular are very widespread in the offshore field and are arranged to a large part below the sea level. For example, the tubular tower of a wind turbine is arranged on the lattice structure.

Known pile foundations comprise a composite structure in a bonding region between the pile and corner post. The bonding region is that region in the longitudinal direction of the pile in which the corner post projects into the pile in the vertical direction. This is also referred to as the overlap length. In the horizontal direction, the bonding region is formed from the pile, the corner post and the space arising between the pile and the corner post. This space is filled with mortar to produce a firm bond in order in this way to produce a non-positive connection between the pile and the corner post. As a rule, the pile extends still further below the bonding region until it is deep in the ground and is also filled there with mortar. Filling with mortar is referred to as grouting.

It is furthermore known to increase the stability of the composite structure by mounting bonding means, namely what are referred to as shear ribs, on the corner post or on the pile inner surface or on both in the bonding region. This is known for example from WO 2011/010937 A1 or from the article "*Statische und dynamische Axialdruckversuche an vergrouteten Rohr-in-Rohr-Verbindungen mit verschiedenen Füllmaterialien*" ["*Static and dynamic axial pressure tests on grouted pipe-in-pipe connections with various filling materials*"], Bautechnik 86 (2009), volume 11, pages 719 et seq., authors: Peter Schaumann et al. These shear ribs are generally formed as rings which are oriented in a horizontal plane on the corner post circumference and/or on the inner pile circumference substantially transversely with respect to the longitudinal axis of the pile connection. Via these shear ribs there occurs improved transmission, capable of withstanding higher loads, of the shear forces acting on the corner post into the mortar or, with an arrangement of the shear ribs on the inner pile circumference, from the mortar to the pile via the shear ribs.

These known pile foundations with shear ribs have the disadvantage that a high-strength mortar has to be used for the bonded connection in order to be able to withstand the loads which occur. This is described for example in the dissertation "*Betontechnologische Einflüsse auf das Tragverhalten von Grouted Joints*" ["*Concrete technology influences on the load-bearing behavior of grouted joints*"], Steffen Anders, Hanover 2007, Gottfried Wilhelm Leibniz University of Hanover, ISBN 978-3-936634-05-1. Furthermore, in this known pile foundation, the overlap length has to be chosen to be very large. Finally, it is considered to be disadvantageous that large gap dimensions have to be provided for "pre-piling", with the result that a relatively large material amount of the expensive high-strength mortar has to be used. These measures are required overall in order to be able to reliably ensure sufficient shear force transmission, but are correspondingly expensive owing to the large amount of high-strength mortar required therefor. There has hitherto also been a lack of binding provisions for dimensioning the bonding region, with the result that, in order to avoid approval problems, rather an overdimensioning with correspondingly increased costs occurs.

The object of the present invention is to provide a composite structure for a pile foundation which overcomes the described disadvantages and which thus, in particular with consistently good or even better load transmission, is more cost-effective in production than the known prior art.

The object is achieved with a composite structure having the characterizing features of claim 1.

The composite structure according to the invention for a pile foundation comprises a hollow pile which is introduced into the ground, a corner post which is connected to the tower structure and which is arranged in the pile with its ends on the connection side, and a bonding region. In the bonding region, the pile and/or corner post have bonding means for transmitting shear forces. As distinguished from the shear ribs known hitherto, these bonding means have an aperture which can be filled by the bonding material to be introduced into the bonding region, and which encloses the bonding material by an angular range of substantially 90° or more than 90°.

Discontinuous bonding means according to the invention for transmitting shear forces are shown by way of example in FIG. 3. These can be, on the one hand, dowels which per se have the aperture required according to the invention, or else, on the other hand, such dowels which only when equipped with anchor loops or with hook anchors become bonding means according to the invention. However, by contrast with the discontinuous bonding means, continuous bonding means are preferred, of which some exemplary embodiments are shown in FIG. 4. These preferred bonding means can also be referred to as bonding strips. For both classes of bonding means—continuous/discontinuous—to achieve a reliable fastening which can be produced simply, it is of advantage if the fastening takes place by means of a welded connection.

It has been recognized in the present invention that an improved pile foundation can be produced if the bonding means have an aperture which can be filled with mortar and which enclose the cured mortar by at least 90°. At least a right angle is thus formed between the pile or corner post and the bonding means. However, the aperture can also be formed at a distance from the corner post or from the pile in the profile of the bonding means, as shown by some examples in FIG. 4. Shear transmission is improved by the fact that the overlap length between the corner post and pile can be designed to be considerably shorter, with the result that the bonding region also becomes shorter and correspondingly less high-strength mortar is required. It is also possible as a result to use a less-strong mortar than hitherto. Both factors have the result that the pile foundation according to the invention can be produced significantly more cost-effectively than the pile foundation known from the prior art.

Consideration is primarily given to the fact that bonding strips are mounted on the corner posts. Furthermore, the known shear ribs can be used on the pile side, inter alia because there the available surface is greater than at the corner post. However, it is of course also possible for the bonding strips to be provided on the pile side.

According to a further advantageous refinement of the invention, there can additionally be provided reinforcing elements which are arranged in the aperture. Such reinforcing elements can be, for example, steel wires etc. which project into the mortar in order in this way to further improve force transmission between the corner post and pile.

According to an advantageous refinement of the invention, the bonding strips according to the invention extend in the direction of the longitudinal axis of the corner post or of the pile. By comparison with a horizontal or diagonal or spiral extent, this is considered to be better producible with a high shear stability.

The apertures in the bonding strips preferably have the form of a clothoid or of a puzzle part. Such strips are known as clothoid strips or puzzle strips. It has been found that these forms withstand the loads which occur particularly well and are particularly suitable for transmitting shear forces.

Furthermore, it is proposed that the strip-shaped bonding means extends over a substantial part of the bonding region. This refinement offers the advantage that continuous force transmission takes place over the substantial part of the bonding region. An extent of over 25%, preferably of over 50%, more preferably of over 75%, is considered to be desirable. This advantageously contributes to reducing the amount of mortar since the overlap length can be reduced with a correspondingly long design of the bonding means.

It is also advantageous according to a further refinement of the invention for a plurality of continuous or strip-shaped bonding means to be distributed circumferentially spaced apart on the corner post circumference and/or on the pile inner surface and in this way also for the continuous and direction-independent dissipation of the shear forces which occur to be improved and for the bonding region which is to be provided to be reduced. The bonding means are preferably arranged so as to be uniformly distributed over the corner post circumference and/or on the pile inner surface.

The present invention furthermore also relates to a foundation for a tower structure, in particular the tower of a wind turbine, in particular of an offshore wind turbine, wherein the foundation has a composite structure according to the invention. Further aspects of the invention relate to a jacket on whose corner posts bonding means according to the invention are formed, and a wind turbine having such a jacket.

The invention will be explained in more detail below with reference to exemplary embodiments which are schematically illustrated in the figures, in which.

Figure 1:
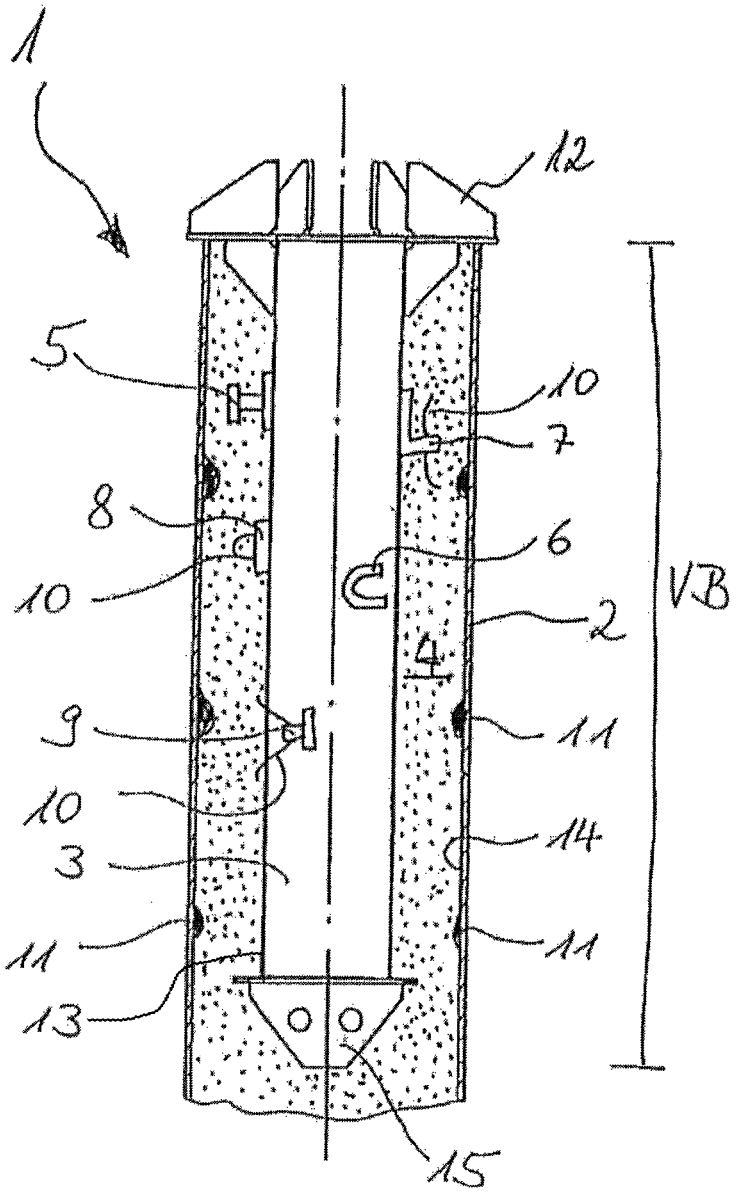
FIG. 1 shows a sectional view of a first exemplary embodiment of a pile foundation according to the invention with discontinuous bonding means.

A pile foundation 1 for an offshore wind turbine is illustrated in FIG. 1.

The pile foundation 1 comprises a hollow pile 2. A connection-side end of a corner post 3 is arranged in the hollow pile 2, wherein the depth of penetration of the corner post 3 is limited by what is referred to as a pile stopper 12.

Figure 3:
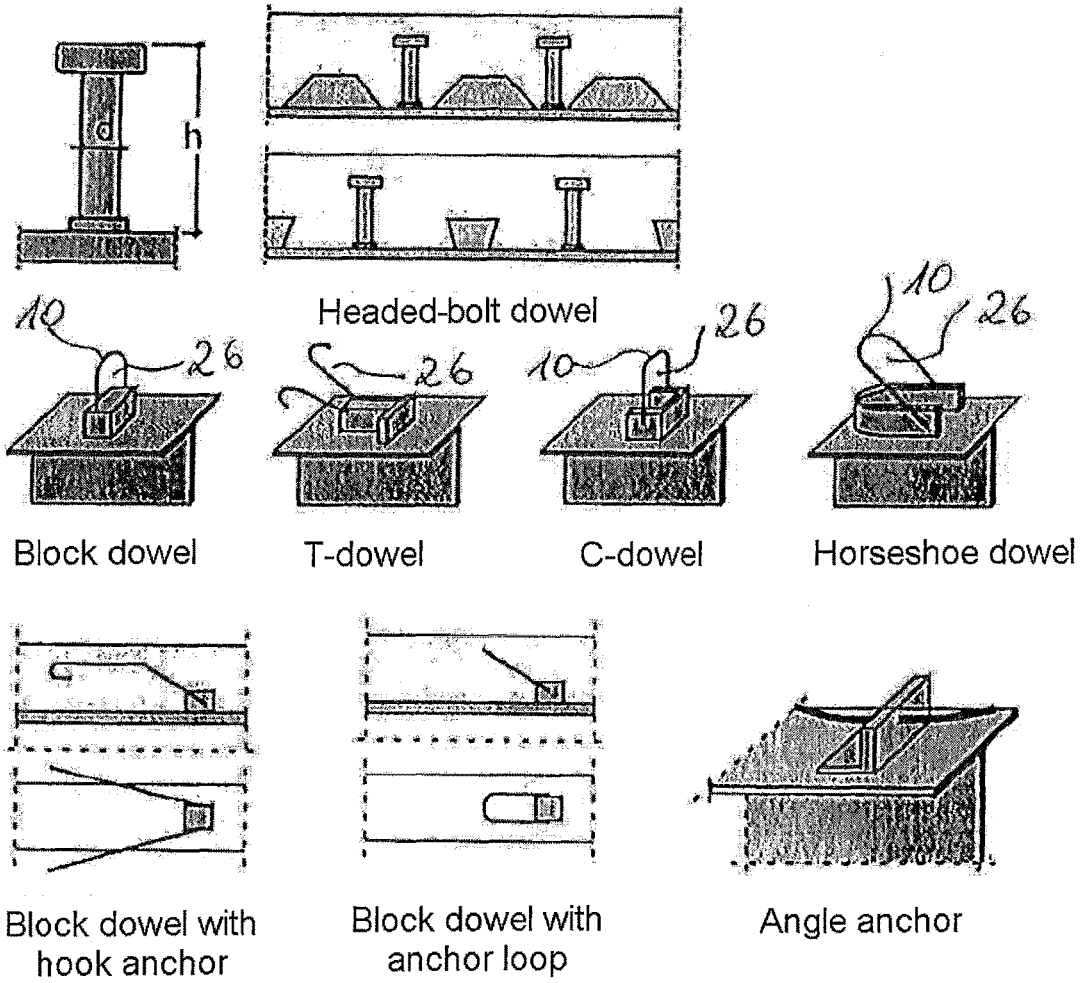
FIG. 3 shows some examples of discontinuous bonding means.

The hollow pile 2 is filled with mortar 4 over its entire represented length, in particular also the overlapping region, designated as bonding region VB, between the pile 2 and the corner post 3. The bonding region VB extends from the upper edge of the pile 2, on which the pile stopper 12 bears, over the entire overlap length of the corner post 3 to the lower tip of the corner post 3. The region of the corner post 3 introduced into the hollow pile 2 is also designated as grout pin 15. In this bonding region VB, various discontinuous bonding means 5, 6, 7, 8, 9, 10 are arranged on the corner post circumference 13. Thus, for example, a headed-bolt dowel 5 is fastened to the corner post 3. The following are also shown: a horseshoe dowel 6 and an angle anchor 7, a block dowel 8 and a T-dowel 9, wherein the angle anchor 7, the block dowel 8 and the T-dowel 9 are additionally provided with anchor loops or hook anchors 10. In addition to these bonding dowels, annular shear ribs 11 are also arranged on the hollow pile inner surface 14, via which shear ribs shear forces are dissipated into the pile 2. Other than shown in FIG. 1, only one type of dowel is generally provided for the practical implementation of the invention. FIG. 1, and in particular also FIG. 3, are intended to show that there are a multiplicity of suitable dowel types. Bonding dowels have already long been used, for example for reinforced concrete bridge construction. A description of corresponding discontinuous and continuous dowels with further references is described, for example, in the dissertation "*Zum Trag- und Verformungsverhalten von Verbundträgern aus ultrahochfestem Beton mit Verbundleisten*" [*"The load-bearing and deformation behavior of composite beams of ultra-high-strength concrete with bonding strips"*], faculty of civil engineering of RWTH Aachen by Mrs Sabine Heinemeyer.

Figure 2:
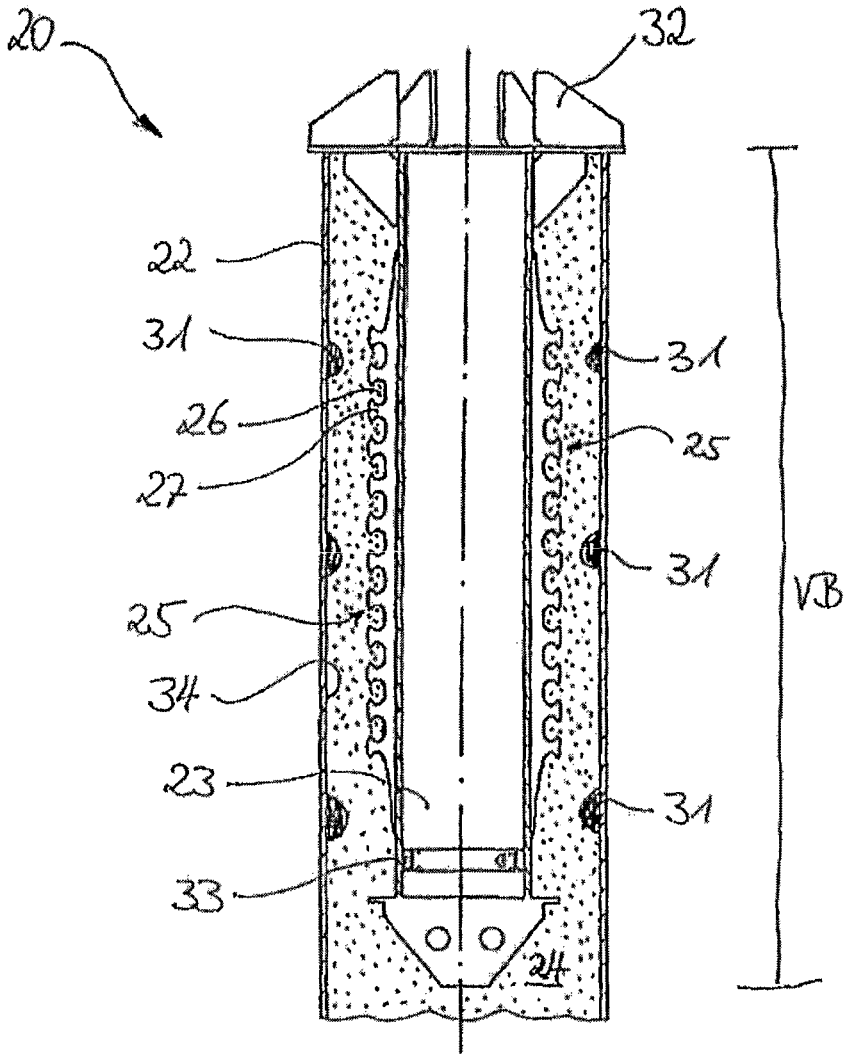
FIG. 2 shows a sectional view of a second exemplary embodiment of a pile foundation according to the invention with continuous bonding means.

An alternative pile foundation 20 for an offshore wind turbine is illustrated in FIG. 2.

The pile foundation 20 also comprises a hollow pile 22 into which there projects a corner post 23, again limited by a pile stopper 32 which comes to bear on the upper pile edge. As was also already the case in the first exemplary embodiment of FIG. 1, in this second exemplary embodiment the hollow pile 22 is also filled with mortar 24 over its entire represented length, in particular thus also the space between the pile 22 and the corner post 23. Load transmission substantially takes place in the bonding region VB which corresponds to the overlapping region between the corner post 23 and hollow pile 22.

In the second exemplary embodiment illustrated in FIG. 2, instead of the discontinuous bonding means from FIG. 1, a plurality of continuous bonding means 25 are now arranged on the corner post circumference 33, for example four bonding strips offset circumferentially by 90°. Furthermore, shear ribs 31 are arranged as additional bonding means on the hollow pile inner surface 34 facing the corner post 23. However, it would also be conceivable, instead of or in addition to the shear ribs 31, for one or more discontinuous and/or continuous bonding means to be arranged on the hollow pile inner surface 34.

The continuous bonding means 25 fastened to the corner post 23 are designed as strips whose longitudinal axis extends parallel to the longitudinal axis of the corner post 23. A longitudinal side of the bonding strip 25 is welded to the corner post 23, and the free longitudinal side opposite to the welded side has apertures 26 between teeth 27.

Figure 4:
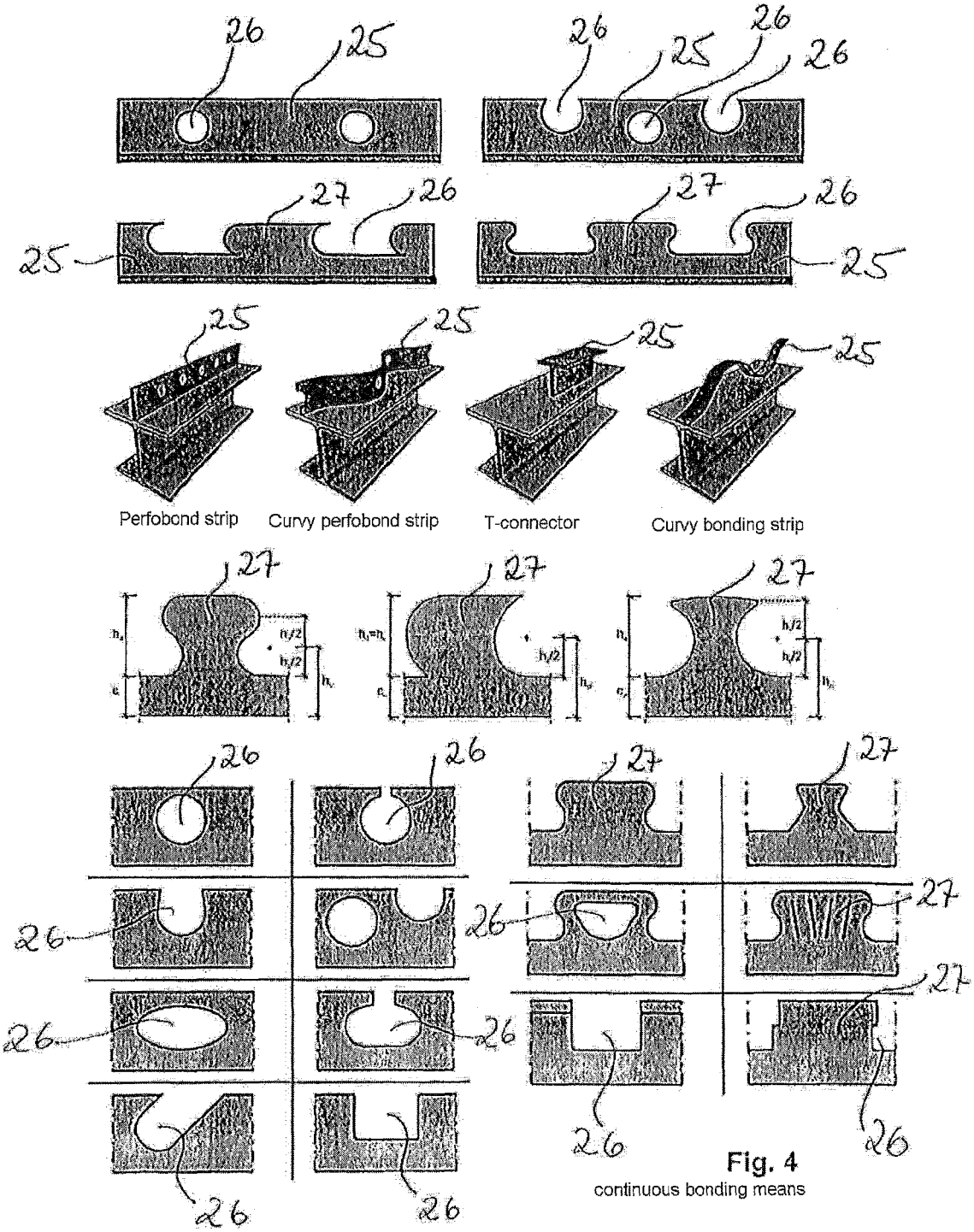
FIG. 4 shows some examples of continuous bonding means.

In the exemplary embodiment illustrated, the apertures 26 have a clothoid design. However, alternative aperture shapes are also conceivable, such as, for example, puzzle-shaped, dovetail-shaped or else droplet-shaped apertures. Further examples of suitable bonding strips are illustrated in FIG. 4.

FIG. 3 shows some non-exhaustive examples of discontinuous bonding means, namely from top left to bottom right:

1st line: headed-bolt dowel;

2nd line: in perspective view, block dowel with anchor loop, T-dowel with hook anchor, C-dowel with anchor loop, horseshoe dowel with anchor loop;

3rd line: block dowel with hook anchor in plan view and side view, block dowel with anchor loop in plan view and side view, angle anchor with hook anchor in perspective view.

FIG. 4 shows some non-exhaustive examples of discontinuous bonding means, namely from top left to bottom right:

1st line: perfobond strip, combination dowel strip (perfobond strip with further edge apertures);

2nd line: sawtooth strip, puzzle strip;

3rd line: in each case welded on a double-T-beam, a perfobond strip, a curvy perfobond strip, a T-connector, a curvy bonding strip;

4th line: the figures show example profiles of apertures 26/teeth 27 of different bonding strips 25.

The invention claimed is:

1. A composite structure for a pile foundation for anchoring a tower structure in ground, comprising:

a hollow pile which is introduced into the ground at an erection site of the tower structure; and a corner post which is connected to the tower structure and which, on a connection side, is arranged within the pile;

wherein the pile and the corner post are fixedly bonded to one another in a bonding region by a cured bonding material, wherein at least one bonding means for transmitting shear forces is fixedly arranged on the corner post in the bonding region, wherein the at least one bonding means has a longitudinal axis that extends parallel to a longitudinal axis of the corner post, wherein a longitudinal side of the bonding means is fastened to the corner post, wherein a free side of the bonding means opposite to the longitudinal side of the bonding means that is fastened to the corner post includes teeth between which apertures are provided, and wherein the apertures are filled with the bonding material.

2. The composite structure as claimed in claim 1, wherein the bonding means has a radial extent which is greater than a wall thickness of the corner post bearing the bonding means.

3. The composite structure as claimed in claim 1, wherein the bonding means is welded to a corner post circumferential surface facing the pile.

4. The composite structure as claimed in claim 1, wherein the bonding means is formed as a continuous bonding strip.

5. The composite structure as claimed in claim 4, wherein the bonding strip extends substantially in a direction of the longitudinal axis of the corner post.

6. The composite structure as claimed in claim 5, wherein the apertures have a clothoid shape or a puzzle part shape.

7. The composite structure as claimed in claim 4, wherein the bonding strip extends over a substantial part of the bonding region.

8. The composite structure as claimed in claim 4, wherein a plurality of continuous bonding means are arranged circumferentially spaced apart on a corner post circumference.

9. A foundation for a tower structure having a composite structure as claimed in claim 1.

10. A jacket for a wind turbine, having at least one corner post, wherein bonding means according to claim 1 are formed on the corner post.

11. A wind turbine having a jacket as claimed in claim 10.

12. A wind turbine having a foundation as claimed in claim 9.

* * * * *